United States Patent [19]

Schatz

[11] 3,941,966

[45] Mar. 2, 1976

[54] RF POWER TRANSMISSION LINE

[75] Inventor: Douglas S. Schatz, Santa Clara, Calif.

[73] Assignee: Applied Materials, Inc., Santa Clara, Calif.

[22] Filed: May 22, 1974

[21] Appl. No.: 472,180

[52] U.S. Cl. ..... 219/10.49; 174/114 R; 174/117 F

[51] Int. Cl.[2] ..... H05B 7/11; H01B 11/12

[58] Field of Search. 174/32, 114 R, 117 F, 117 FF; 219/10.49

[56] References Cited

UNITED STATES PATENTS

| | | | |
|---|---|---|---|
| 238,195 | 2/1881 | Brooks | 174/32 |
| 3,106,600 | 10/1963 | Crosby | 174/114 R |
| 3,576,941 | 5/1971 | Colglazier | 174/117 FF |
| 3,586,757 | 6/1971 | Haldeman | 174/117 FF |
| 3,649,434 | 3/1972 | Mortenson | 174/117 F |

FOREIGN PATENTS OR APPLICATIONS

| | | | |
|---|---|---|---|
| 3,004 | 1885 | United Kingdom | 174/117 F |

*Primary Examiner*—E. A. Goldberg
*Attorney, Agent, or Firm*—Flehr, Hohbach, Test, Albritton & Herbert

[57] ABSTRACT

Transmission line for RF power utilizing generally flat supply and return lines each comprising a plurality of flexible, insulated conductors connected together at their ends. The two lines are enclosed in a flexible sheath which holds the lines in close proximity to each other, and fields produced by the lines tend to cancel each other.

2 Claims, 4 Drawing Figures

FIG-1
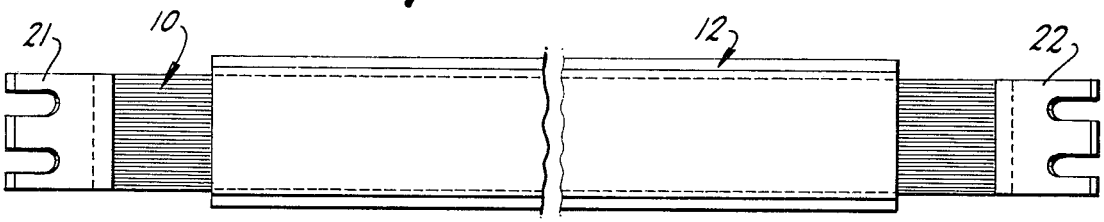
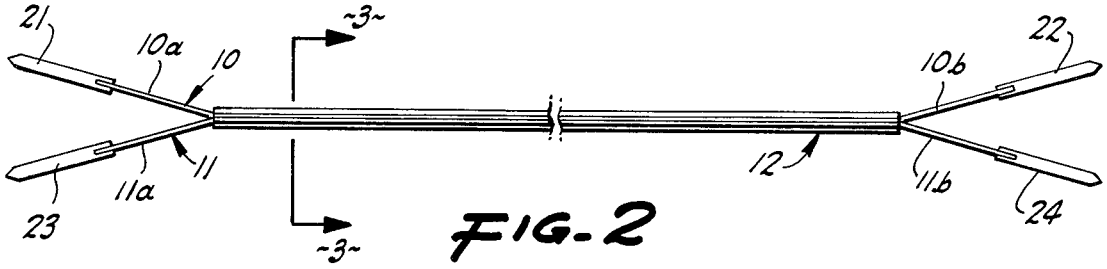
FIG-2
FIG-3
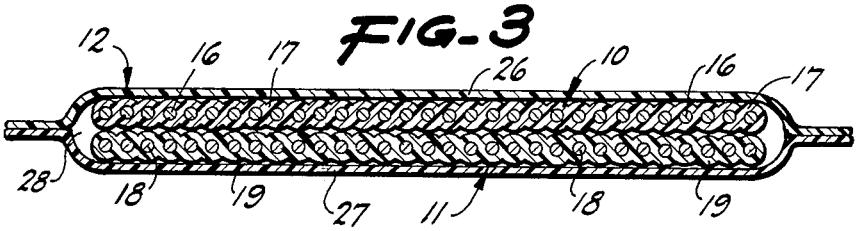
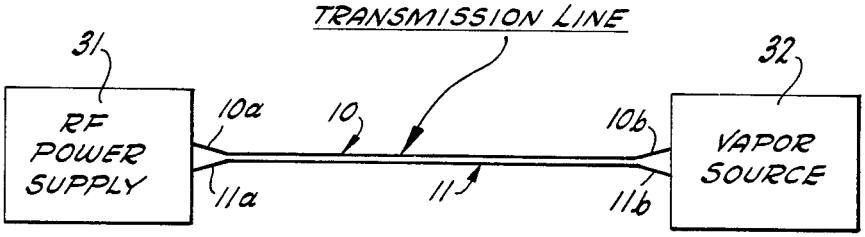
FIG-4

RF POWER TRANSMISSION LINE

BACKGROUND OF THE INVENTION

This invention pertains generally to electrical transmission lines and more particularly to a transmission line for carrying radio frequency power from an RF power supply to the work coil of an induction heated vapor source.

Induction heated vapor sources utilized in thin film deposition have a work coil which is energized with RF energy to produce a magnetic field which induces current in the load or susceptor and subsequently heats and vaporizes the metal to be deposited. With induction heated vapor sources of the prior art, the RF current required to vaporize materials commonly used in vapor desposition is typically on the order of several hundred amperes. A current of this magnitude requires a relatively large effective conductor, and because of the poor use factor and losses due to the so-called skin effect, i.e. the tendency of high frequency currents to be concentrated toward the outer surface of a conductor, hollow water cooled conductors are generally employed for supplying the RF current to vapor source work coils. The hollow conductors are commonly fabricated of copper, and they are expensive and difficult to use.

SUMMARY AND OBJECTS OF THE INVENTION

The invention provides a power transmission line for induction heated vapor sources utilizing generally flat supply and return lines each comprising a plurality of flexible, insulated conductors connected together at their ends. The two lines are enclosed in a flexible sheath which holds the lines in a closely spaced superposed position in which the fields produced by the lines tend to cancel each other.

It is in general an object of the invention to provide a new and improved transmission line for RF power.

Another object of the invention is to provide a transmission line of the above character which is particularly suitable for use in carrying RF power to the work coil of an induction heated vapor source.

Another object of the invention is to provide a transmission line of the above character having supply and return lines each formed of a plurality of insulated conductors disposed side-by-side and connected together at their ends.

Another object of the invention is to provide a transmission line of the above character in which the supply and return lines are disposed in proximity to effect field cancellation.

Additional objects and features of the invention will be apparent from the following description in which the preferred embodiment is set forth in detail in conjunction with the accompanying drawings.

BRIEF DESCRIPTION OF THE DRAWINGS

FIG. 1 is a top plan view of a transmission line according to the invention.

FIG. 2 is an elevational view of the transmission line of FIG. 1.

FIG. 3 is an enlarged cross-sectional view taken along line 3—3 in FIG. 2.

FIG. 4 is a block diagram, illustrating the use of the transmission line of FIG. 1 in connection with an RF power supply and an induction heated vapor source.

DESCRIPTION OF THE PREFERRED EMBODIMENT

The transmission line includes a generally flat supply line 10, a generally flat return line 11, and an elongated sheath 12 which holds the supply and return lines together.

Supply line 10 comprises a plurality of longitudinally extending electrical conductors 16, each of which is provided with an insulative jacket 17. The insulated conductors are disposed side-by-side, and in the preferred embodiment, the insulative jackets of adjacent conductors are fused or otherwise bonded together to form a unitary structure, with the conductors remaining insulated from each other.

Return line 11 is similar to supply line 10 and includes a plurality of longitudinally extending conductors 18 having insulative jackets 19. Conductors 18 are also disposed side-by-side, and jackets 19 are preferably fused or otherwise bonded together to form a unitary structure.

At the ends of the supply and return lines, the conductors of each line are connected electrically together, and each line functions as a single conductor. In the embodiment illustrated, the ends of supply line conductors 16 are soldered to connectors 21, 22, and the ends of return line conductors 18 are soldered to connectors 23, 24. These connectors are fabricated of an electrically conductive material such as copper or brass.

The number and size of the conductors used in the supply and return lines is largely dependent upon the current which the line is to carry. In a preferred transmission line for a 50 KHz current on the order of 80 amperes RMS, for example, the supply and return lines each have 30 number 20 stranded copper wire conductors. In the preferred embodiment, insulative jackets 17 and 19 are fabricated of polyvinyl chloride which can be used at temperatures up to about 100° C. If the line is to be subjected to higher temperatures, insulative materials with higher working temperatures, such as irradiated polyvinyl chloride and kapton, can be used.

In the embodiment illustrated, sheath 12 comprises two sheets 26, 27 of a flexible insulating material, such as vinyl plastic, bonded together along their outer edges to form a chamber 28 which is adapted to receive the supply and the return lines and hold them in close proximity in a superposed position, as illustrated in FIG. 3. The sheath extends substantially the entire length of the supply and return lines, although portions of the lines, designated 10*a*, 10*b*, 11*a*, and 11*b*, extend beyond the ends of the sheath to form leads for connecting the transmission line to the terminals of a power source and load. If desired, the sheath can be formed of a heat shrinkable material.

Operation and use of the transmission line can be described briefly with reference to FIG. 4 wherein the line is shown connected between an RF power supply 31 and a vapor source 32 of the induction heated type. RF current from power supply 31 flows through conductors 10 and 11 to the work coil in the vapor source 32, and the magnetic and electric fields produced by the current in the two lines tend to cancel each other.

The transmission line has a number of important features and advantages. It is flexible, light in weight, and easy to use. Moreover, it is economical and easy to manufacture. The multiconductor supply and return lines have two to three times the current carrying capacity of flat strip conductors of comparable cross-sectional area, and the positioning of the two lines in close proximity provides effective cancellation of the electric and magnetic fields produced by the RF current in the lines.

Unlike flat strip conductors where the current tends to be concentrated in the outer edges of the conductor, in the multiconductor transmission line of the invention the current tends to be distributed evenly among the conductors across the line. Field cancellation occurs between pairs of individual conductors in the supply and return lines, and this cancellation helps to keep the current toward the centers of the individual conductors. In addition, the multiconductor line is more flexible and easier to use than a line having flat strip conductors.

It is apparent from the foregoing that a new and improved transmission line has been provided. While only the presently preferred embodiment has been described as will be apparent to those familiar with the art, certain changes and modifications can be made without departing from the scope of the invention as defined by the following claims.

I claim:

1. In a transmission line for delivering power from a radio frequency power supply to the work coil of an induction heated vapor source:

A. a radio frequency power source;

B. an induction heated vapor source having a work coil adapted to be energized with RF energy to produce a magnetic field for inducing a current in a material to be vaporized or in an electrically conductive susceptor in contact with the material to be vaporized;

C. a supply line comprising a plurality of flexible electrically conductive wires disposed side-by-side extending between the power supply and vapor source and flexible electrically insulative material encasing the wires to form a generally flat unitary structure in which the wires are insulated from each other;

D. means connecting the ends of the supply line wires electrically together at the power supply and vapor source, respectively;

E. a return line comprising a plurality of flexible electrically conductive wires disposed side by-side extending between the power supply and vapor source and flexible electrically insulative material encasing the wires to form a generally flat unitary structure in which the wires are insulated from each other;

F. means connecting the ends of the return line wires electrically together at the power supply and vapor source, respectively; and G. an insulative flexible sheath extending substantially the length of the supply and return lines serving to hold the lines together in a closely spaced superposed position and permit at least limited longitudinal movement of the lines relative to each other and to the sheath.

2. In a transmission line for delivering power from a source to a load:

A. a first group of longitudinally extending flexible wire conductors disposed side-by-side and connected electrically together at their ends to form a generally flat supply line for connection between the source and load, said conductors having individual insulative jackets encasing the same, said jackets being bonded together along their lateral edges to form a unitary structure;

B. a second group of longitudinally extending flexible wire conductors disposed side-by-side and connected electrically together at their ends to form a generally flat return line for connection between the source and load, said conductors having individual insulative jackets encasing the same, said jackets being bonded together along their lateral edges to form a unitary structure; and C. flexible sheath means encasing the supply and return lines and holding said lines in close proximity to each other, said sheath means permitting longitudinal movement of the lines relative to each other and to the sheath means.

* * * * *